US007094181B2

(12) United States Patent
Hall

(10) Patent No.: US 7,094,181 B2
(45) Date of Patent: Aug. 22, 2006

(54) TRANSPORTABLE TRAMPOLINE SYSTEM

(76) Inventor: David Hall, 364 W. 200 North, Manti, UT (US) 84642

( * ) Notice: Subject to any disclaimer, the term of this patent is extended or adjusted under 35 U.S.C. 154(b) by 177 days.

(21) Appl. No.: 10/687,161

(22) Filed: Oct. 15, 2003

(65) Prior Publication Data

US 2005/0130804 A1 Jun. 16, 2005

Related U.S. Application Data

(63) Continuation-in-part of application No. 09/843,022, filed on Apr. 26, 2001, now Pat. No. 6,648,799.

(51) Int. Cl.
*A63B 21/00* (2006.01)

(52) U.S. Cl. ..... 482/27; 482/28; 482/51

(58) Field of Classification Search ..... 482/27–29; 190/18 A, 15

See application file for complete search history.

(56) References Cited

U.S. PATENT DOCUMENTS

| | | | | | |
|---|---|---|---|---|---|
| 2,534,019 | A | | 12/1950 | Griswold | 5/111 |
| 3,004,623 | A | * | 10/1961 | Nissen | 482/28 |
| 3,116,809 | A | | 1/1964 | Nissen | 182/224 |
| 3,276,544 | A | | 10/1966 | Hall | 182/139 |
| 3,356,366 | A | | 12/1967 | Barthel | 272/65 |
| 4,119,311 | A | | 10/1978 | Jenkins et al. | 272/65 |
| 4,139,192 | A | | 2/1979 | McNeil | 272/65 |
| 4,159,826 | A | | 7/1979 | Hancock | 272/65 |
| 4,162,063 | A | | 7/1979 | Nissen et al. | 267/73 |
| RE30,344 | E | | 7/1980 | McNeil | 272/65 |
| 4,284,271 | A | | 8/1981 | Pettit et al. | 272/70 |
| 4,336,933 | A | | 6/1982 | Appelbaum | 272/70 |
| 4,337,942 | A | | 7/1982 | Sidlinger et al. | 272/144 |
| 4,339,123 | A | | 7/1982 | Rich | 272/65 |
| 4,381,861 | A | | 5/1983 | Howell, Jr. et al. | 272/65 |
| 4,386,772 | A | | 6/1983 | Wu | 272/65 |
| D270,557 | S | | 9/1983 | Williams | D21/235 |
| 4,415,151 | A | * | 11/1983 | Daniels | 482/28 |
| 4,452,444 | A | * | 6/1984 | Schulze, Jr. | 482/27 |
| 4,477,070 | A | | 10/1984 | Appelbaum | 272/70 |
| 4,483,531 | A | | 11/1984 | Laseman et al. | 272/65 |
| 4,489,933 | A | | 12/1984 | Fisher et al. | 272/65 |
| 4,563,001 | A | | 1/1986 | Terauds | 272/72 |
| 4,564,193 | A | | 1/1986 | Stewart | 272/118 |
| 4,576,375 | A | | 3/1986 | Roberts | 272/65 |
| 4,598,904 | A | | 7/1986 | Roth | 272/65 |
| 4,598,905 | A | | 7/1986 | Vrana | 272/65 |
| 4,630,816 | A | | 12/1986 | Hill | 272/70 |
| 4,644,892 | A | | 2/1987 | Fisher | 114/264 |
| D291,712 | S | | 9/1987 | Koivisto | D21/191 |
| 4,706,953 | A | | 11/1987 | Graham | 272/120 |
| 4,730,826 | A | | 3/1988 | Sudmeier | 272/65 |
| 4,776,581 | A | | 10/1988 | Shepherdson | 272/65 |
| 4,790,529 | A | | 12/1988 | Pelle | 272/93 |
| 4,824,100 | A | | 4/1989 | Hall et al. | 272/65 |
| 4,836,530 | A | | 6/1989 | Stanley, Jr. | 272/65 |

(Continued)

*Primary Examiner*—Jerome W. Donnelly
(74) *Attorney, Agent, or Firm*—Starkweather & Associates; Michael W. Starkweather; Jason P. Webb

(57) ABSTRACT

A portable trampoline exercise system, including a foldable trampoline with long-lasting rigidity in the frame and a specifically adapted carrying case for transporting the folded trampoline. The trampoline is made foldable by using hinges to connect sections of the frame of the trampoline. The hinges are configured to provide lateral flexibility in the frame, thereby reducing the damage caused by stresses applied to the hinges (and therefore increasing the life of the hinges) when the trampoline is folded.

24 Claims, 17 Drawing Sheets

U.S. PATENT DOCUMENTS

| | | | | |
|---|---|---|---|---|
| 4,863,156 | A | 9/1989 | Shaw | 272/65 |
| 4,863,160 | A | 9/1989 | Pelle | 272/93 |
| D304,850 | S | 11/1989 | Chambers | D21/235 |
| 4,900,011 | A | 2/1990 | Nolet | 272/65 |
| 5,074,550 | A | 12/1991 | Sloan | 272/130 |
| D325,951 | S | 5/1992 | Johnson | D21/235 |
| 5,221,241 | A | 6/1993 | Bare, II | 482/43 |
| 5,299,989 | A | 4/1994 | Boyd et al. | 482/27 |
| 5,371,936 | A | 12/1994 | Blanchard | 29/436 |
| 5,385,518 | A | 1/1995 | Turner | 482/27 |
| D362,478 | S | 9/1995 | Wilkinson et al. | D21/191 |
| D363,325 | S | 10/1995 | Wilkinson | D21/191 |
| 5,484,362 | A | 1/1996 | Skowronski et al. | 482/54 |
| 5,533,948 | A | 7/1996 | Wilkinson | 482/27 |
| 5,545,110 | A | 8/1996 | Hsiang | 482/27 |
| 5,575,738 | A | 11/1996 | Millington et al. | 482/35 |
| 5,599,259 | A | 2/1997 | Skowronski et al. | 482/54 |
| 5,605,462 | A | 2/1997 | Denne | 434/55 |
| 5,607,377 | A | 3/1997 | Wilkinson | 482/83 |
| D384,115 | S | 9/1997 | Wilkinson et al. | D21/191 |
| 5,704,882 | A | 1/1998 | Coates et al. | 482/69 |
| 5,729,852 | A | 3/1998 | Rabideau et al. | 5/710 |
| 5,788,606 | A | 8/1998 | Rich | 482/27 |
| 5,810,695 | A | 9/1998 | Sass | 482/27 |
| 5,876,311 | A | 3/1999 | Coates et al. | 482/77 |
| 5,934,679 | A | 8/1999 | Strain et al. | 273/395 |
| 5,967,943 | A | 10/1999 | Rich | 482/27 |
| 6,036,620 | A | 3/2000 | Yang | 482/27 |
| 6,042,514 | A | 3/2000 | Abelbeck | 482/54 |
| 6,053,845 | A | 4/2000 | Publicover et al. | 482/35 |
| 6,071,213 | A | 6/2000 | Raasch et al. | 482/29 |
| D428,955 | S | 8/2000 | Peterson | D21/801 |
| 6,095,951 | A | 8/2000 | Skowronski et al. | 482/27 |
| 6,110,074 | A | 8/2000 | Tacquet | 482/27 |
| 6,126,578 | A | 10/2000 | Lapointe | 482/77 |
| 6,129,649 | A | 10/2000 | Yang | 482/27 |
| 6,132,338 | A | 10/2000 | Shifferaw | 482/30 |
| 6,135,922 | A | 10/2000 | Nissen | 482/27 |
| 6,162,061 | A * | 12/2000 | Taylor | 434/253 |
| 6,174,266 | B1 | 1/2001 | Merrill | 482/35 |
| 6,193,632 | B1 | 2/2001 | Steger | 482/27 |
| 6,210,285 | B1 | 4/2001 | Susko | 472/50 |
| 6,237,169 | B1 | 5/2001 | Ying | 5/111 |
| 6,261,207 | B1 | 7/2001 | Publicover et al. | 482/27 |
| 6,264,583 | B1 | 7/2001 | Rich | 482/27 |
| 6,302,250 | B1 * | 10/2001 | Sadow et al. | 190/18 A |
| 6,319,174 | B1 | 11/2001 | Alexander | 482/27 |
| 6,346,065 | B1 | 2/2002 | Lapointe | 482/77 |
| 6,371,434 | B1 | 4/2002 | Becker et al. | 248/610 |
| 6,402,662 | B1 | 6/2002 | Rieber | 482/27 |
| 6,409,633 | B1 | 6/2002 | Abelbeck | 482/54 |
| D462,103 | S | 8/2002 | Chen | D21/797 |
| 6,447,426 | B1 | 9/2002 | Peterson | 482/27 |
| 6,648,799 | B1 * | 11/2003 | Hall | 482/28 |

* cited by examiner

TRANSPORTABLE TRAMPOLINE SYSTEM

CROSS REFERENCE TO RELATED APPLICATIONS

This application is a continuation-in-part application of co-owned and U.S. patent application Ser. No. 09/843,022, filed on Apr. 26, 2001 now U.S. Pat. No. 6,648,799, and priority is hereby claimed thereto for all common material.

BACKGROUND OF INVENTION

1. Field of the Invention

This invention relates to trampoline devices. More specifically, this invention relates to trampoline devices designed for use as portable exercise equipment.

2. Description of Related Art

A variety of trampoline devices are well known in the art. Generally, these prior devices are not easily transportable, do not include specially designed carrying cases and do not facilitate tool-less assembly.

Although the following references may not constitute prior art, the reader is referred to the following U.S. patent documents for general background material. Each of these patents is hereby incorporated by reference in its entirety for the material contained therein.

U.S. Pat. No. 2,534,019 describes a foldable framework, particularly for a trampoline, but also capable of use in folding beds, cots and the like.

U.S. Pat. No. 3,116,809 describes a supporting stand for rebound tumbling apparatus having a frame and supporting leg structure collapsible into a flat rectangular unit.

U.S. Pat. No. 3,276,544 describes a trampoline.

U.S. Pat. No. 3,356,366 describes a gymnastic catapulting device for use in exercise and gymnastic activities.

U.S. Pat. No. 4,119,311 describes a pair of detachable L-shaped auxiliary supports attachable to a conventional trampoline for supporting the trampoline bed in an upright position to convert the trampoline into a rebounding device.

U.S. Pat. Nos. 4,139,192 and Re. 30,344 describe round trampolines having a sectional, circular frame combined with a circular mat of lesser diameter than the frame resiliently supported from the frame by a plurality of radially arranged coil springs.

U.S. Pat. No. 4,159,826 describes a pneumatically sustained, flexible exercise surface and platform.

U.S. Pat. No. 4,162,063 describes adjustable springs for trampolines and the like.

U.S. Pat. No. 4,284,271 describes a hexagonal jogging platform having a tubular support frame with rounded corners, detachable, tubular support legs at each corner and a fabric platform attached to the tubular frame.

U.S. Pat. No. 4,336,933 describes an exercise apparatus for in-place jogging that includes a support structure mounting a taunt tramping mat and a wall mounted housing.

U.S. Pat. No. 4,337,942 describes a portable exercising device, which can be assembled and disassembled without the use of special tools for shipping and storage.

U.S. Pat. No. 4,339,123 describes a demountable trampoline capable of being separated into components suitable for compact packaging for shipment.

U.S. Pat. No. 4,381,861 describes a trampoline perimeter frame and support legs for the perimeter frame that are fabricated as identically sized and shaped members enabling the use of only one fabricating jig.

U.S. Pat. No. 4,386,772 describes a trampoline with horizontal tension springs and vertical compression springs.

U.S. Pat. No. Des. 270,557 describes an ornamental design for a trampoline.

U.S. Pat. No. 4,415,151 describes a collapsible rebound exercise apparatus as a resilient, flexible mat capable of forming a substantially planar surface when an associated frame supporting the mat has an open framework thereof disposed in a substantially planar, open position.

U.S. Pat. No. 4,477,070 describes a portable apparatus for in-place jogging that includes a housing to which is pivotally mounted a structure that supports a jogging surface.

U.S. Pat. No. 4,483,531 describes an exercise device in the form of a pair of trampolines which are spaced apart but sufficiently close together such that a person can rebound from one device to the other using first one leg on one trampoline and the other leg on the other without contacting or touching the floor.

U.S. Pat. No. 4,489,933 describes an exercise device that uses a resilient fabric sheet to from a trampoline type surface.

U.S. Pat. No. 4,563,001 describes a portable exercising device having a pair of laterally spaced lever arms whose forward ends are pivotally attached to a base frame assembly.

U.S. Pat. No. 4,564,193 describes an exercise apparatus having a frame, which includes frame members joined by detachable couplings and a cable system having a take-up reel, and one or more cable reels.

U.S. Pat. No. 4,576,375 describes a flotation trampoline adapted for use on a body of water.

U.S. Pat. No. 4,598,904 describes a water trampoline that includes a buoyant inflatable base.

U.S. Pat. No. 4,598,905 describes an attachable safety steadying structure for the conventional trampoline.

U.S. Pat. No. 4,630,816 describes a jogging apparatus, that comprises a tubular frame, an elastomeric member bonded to the frame and a mat bonded to the elastomeric member when the elastomeric member is preloaded radially inwardly so that when the load on the elastomeric member is released, the mat is tightly stretched on the frame to provide the jogging surface.

U.S. Pat. No. 4,644,892 describes a water-borne buoyant device to enable users to enjoy leisure time activity in an aquatic environment.

U.S. Pat. No. Des. 291,712 describes an ornamental design for a trampoline.

U.S. Pat. No. 4,706,953 describes an active/passive exercise apparatus, which provides a platform that is roller mounted on parallel tracks.

U.S. Pat. No. 4,730,826 describes a rebounding exercise device, which provides at least two rebounding surfaces that are supported at an incline relative to horizontal.

U.S. Pat. No. 4,776,581 describes an exercise apparatus that includes a tank or other receptacle designed to be filled with an aqueous fluid.

U.S. Pat. Nos. 4,790,529 and 4,863,160 describe multi-positionable arrangements of substantially parallel bars, which form a substantial track for a ball having mounting means.

U.S. Pat. No. 4,824,100 describes an exercise device having opposed angled rebound surfaces that will fold flat together, and support structures for the surfaces that will also fold compactly.

U.S. Pat. No. 4,836,530 describes a trampoline-like aerobic exerciser apparatus and method.

U.S. Pat. No. 4,863,156 describes a trampoline that includes a sheet resiliently supported and tensioned by a substantially rigid frame through means of spring-like members positioned about the perimeter of the sheet.

U.S. Pat. No. Des. 304,850 describes an ornamental design for a trampoline exerciser.

U.S. Pat. No. 4,900,011 describes a new and useful playpen and exercise structure for an infant or small child.

U.S. Pat. No. 5,074,550 describes an exercise apparatus that includes a mini-trampoline, a frame, a first pole, a second pole, a first hydraulic shock, and a second hydraulic shock.

U.S. Pat. No. Des. 325,951 describes an ornamental design for a trampoline exerciser.

U.S. Pat. No. 5,221,241 describes a gymnastic training device.

U.S. Pat. No. 5,299,989 describes an all-surface trampoline that comprises a hollow inflatable support having an inner and an outer periphery and having an open space between the inner periphery.

U.S. Pat. No. 5,371,936 describes a tool for attaching springs to a trampoline mat.

U.S. Pat. No. 5,385,518 describes a water trampoline that has a plurality of interconnected suspension members.

U.S. Pat. Nos. Des 362,478 and Des 363,325 describe ornamental designs for a trampoline exerciser.

U.S. Pat. Nos. 5,484,362, 5,599,259 and 6,095,951 describe exercise treadmills.

U.S. Pat. No. 5,533,948 describes a combination exercise device that includes a trampoline.

U.S. Pat. No. 5,545,110 describes a jumping bed of a trampoline that is secured to the trampoline frame by passing an electric rubber cord through a plurality of channels.

U.S. Pat. No. 5,575,738 describes an exercise and play apparatus that includes inflatable bottom and sidewall portions.

U.S. Pat. No. 5,605,462 describes a control mechanism for a simulator or stabilizing platform.

U.S. Pat. No. 5,607,377 describes a rebounder and punching bag-boxing fitness device.

U.S. Pat. No. Des. 384,115 describes an ornamental design for a trampoline exerciser.

U.S. Pat. Nos. 5,704,882 and 5,876,311 describe rebound-type exercise devices, which allow an individual to perform a sit and bounce exercise.

U.S. Pat. No. 5,729,852 describes a balloon filled bag for use as a mattress or children's trampoline.

U.S. Pat. No. 5,788,606 describes a trampoline system that includes a trampoline having a frame and an adjustable support for supporting a user of the trampoline.

U.S. Pat. No. 5,810,695 describes a water trampoline that includes a hollow inflatable frame member that has a textured covering with a plurality of bands interconnected.

U.S. Pat. No. 5,934,679 describes a bounce back hockey net for use with a hockey puck.

U.S. Pat. No. 5,967,943 describes a trampoline that includes a trampoline mat, a frame surrounding the trampoline mat and an attachment system for connecting the frame to the trampoline mat.

U.S. Pat. No. 6,036,620 describes a trampoline that includes a trampoline frame and a jumping bed.

U.S. Pat. No. 6,042,514 describes a movable surface conveyor system exercise device.

U.S. Pat. No. 6,053,845 describes a trampoline or the like with a fence enclosure.

U.S. Pat. No. 6,071,213 describes a trampoline convertible for use as a swimming pool.

U.S. Pat. No. Des. 428,955 describes an ornamental design for a water trampoline.

U.S. Pat. No. 6,110,074 describes a mini trampoline in which the frame is made in several parts in order to be easily carried and assembled.

U.S. Pat. No. 6,126,578 and U.S. Pat. No. 6,346,065 B1 describe jumping devices having a high rebound platform.

U.S. Pat. No. 6,129,649 describes a trampoline having a jumping bed with elastic straps for supporting the same on the trampoline frame.

U.S. Pat. No. 6,132,338 describes an exercise board that comprises a generally rectangular platform having a laminated structure.

U.S. Pat. No. 6,135,922 describes an attachment for a circular trampoline.

U.S. Pat. No. 6,174,266 B1 describes a play and climbing equipment structure.

U.S. Pat. No. 6,193,632 B1 and U.S. Pat. No. 6,402,662 B1 describe trampoline pad assemblies for securement to a trampoline.

U.S. Pat. No. 6,210,285 B1 describes a beach sling-jump amusement device for ejecting occupants into the air.

U.S. Pat. No. 6,237,169 B1 describes a foldable trampoline.

U.S. Pat. No. 6,261,207 B1 describes a fence that surrounds a trampoline and extends above the rebounding surface.

U.S. Pat. No. 6,264,583 B1 describes a trampoline that includes a trampoline mat, a frame surrounding the trampoline mat and an attachment system for connecting the frame to the trampoline mat.

U.S. Pat. No. 6,319,174 B1 describes a trampoline, which incorporates a flexible mat supported above a support frame by a number of flexible rods.

U.S. Pat. No. 6,371,434 B1 describes a spring arrangement for mounting a vibration or shock sensitive device.

U.S. Pat. No. 6,409,633 B1 describes a movable surface conveyor system, especially used as an exercise treadmill.

U.S. Pat. No. D462,103 S describes an ornamental design for an air inflatable trampoline.

U.S. Pat. No. 6,447,426 B1 describes a water trampoline that includes a supporting shell and a plurality of concentrically disposed inflatable rings.

SUMMARY OF INVENTION

It is desirable to provide a trampoline exercise system that is specifically adapted for portability. It is particularly desirable to provide such an exercise system that provides a folded trampoline device that can be easily assembled without tools, within a specially designed carrying case.

Accordingly, it is an object of this invention to provide a trampoline exercise system that includes a foldable trampoline device.

Another object of this invention is to provide a trampoline exercise system that includes a specially designed carrying case for the foldable trampoline device.

A further object of this invention is to provide a trampoline exercise system that includes a foldable trampoline device that can be easily assembled without tools.

Additional objects, advantages and other novel features of this invention will be set forth in part in the description that follows and in part will be apparent to those skilled in the art upon examination of the following or may be learned with the practice of the invention. The objects and advantages of this invention may be realized and attained by means of the instrumentalities and combinations particularly pointed out in the appended claims. Still other objects of the present invention will become readily apparent to those skilled in the art from the following description wherein there is shown and described present preferred embodiments of the invention, simply by way of illustration of the best modes currently known to carry out this invention. As it will be realized, this invention is capable of other different embodiments, and its several details, and specific components, dimensions and materials, are capable of modification in various aspects without departing from the invention. Accordingly, the drawings and descriptions should be regarded as illustrative in nature and not as restrictive.

BRIEF DESCRIPTION OF DRAWINGS

The accompanying drawings incorporated in and forming a part of the specification, illustrate embodiments of the present invention. Some, although not all, alternative embodiments are described in the following description.

In the drawings.

Reference will now be made in detail to the present preferred embodiments of the invention, examples of which are illustrated in the accompanying drawings.

DETAILED DESCRIPTION

This invention is a system for physical exercise, therapy and rehabilitation. Trampoline type devices are well known for use in exercise; however, such devices have typically lacked desirable portability and/or necessary structural strength, which are important for effective use as an exercise device. This invention includes a foldable trampoline device, having foldable legs and hinges configured to provide lateral flexibility in the framework, to thereby decrease the stress imposed on the hinges, thereby increasing the life of the hinges, when the trampoline is folded, along with a specifically designed carrying case, having features to accommodate and enhance the portability of the foldable trampoline exercise device.

Figure 1:
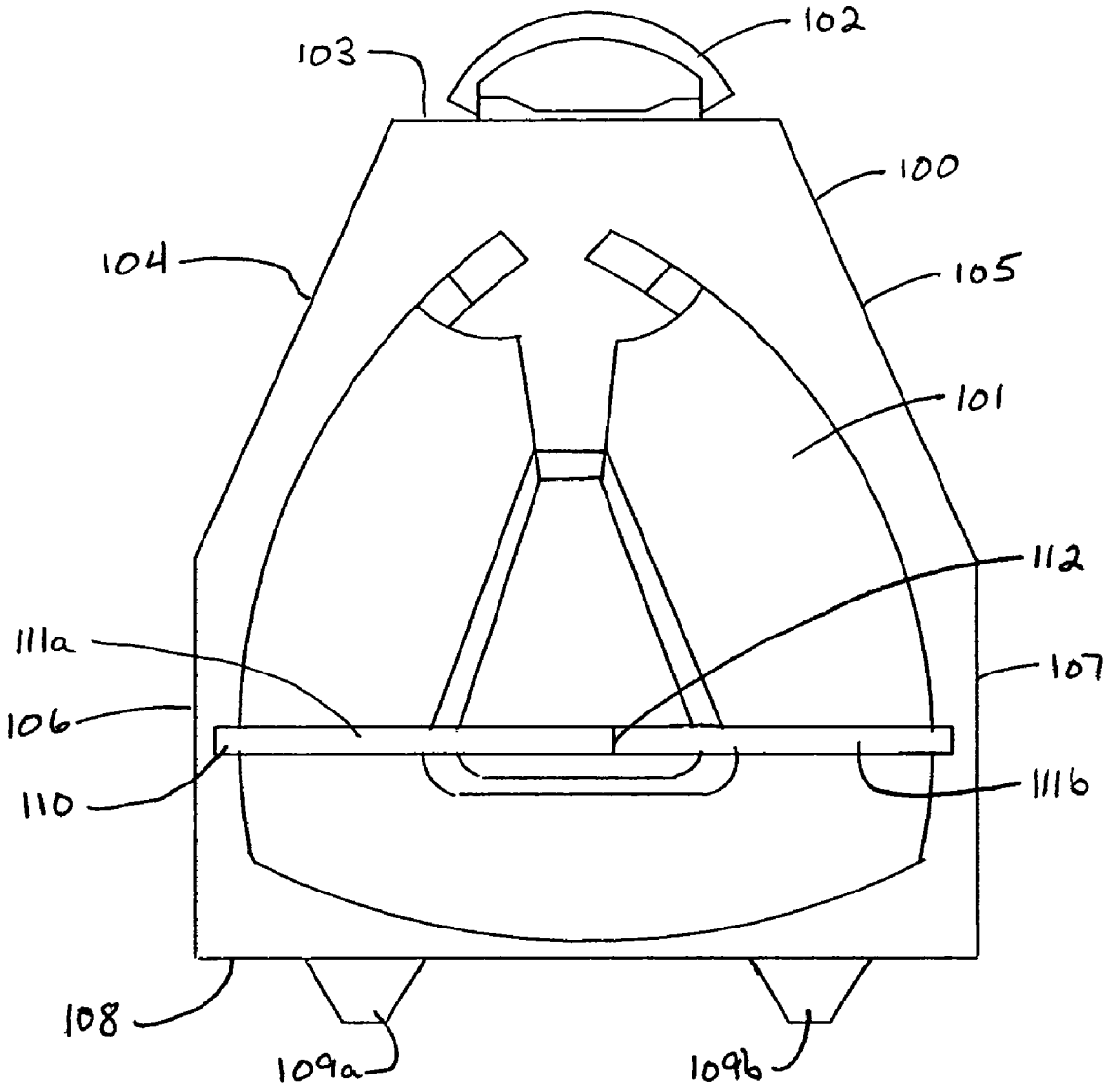
FIG. 1 is a drawing of the system of this invention with the carrying case open to reveal the folded trampoline.

FIG. 1 shows a drawing of the system of this invention with the carrying case 100 open to reveal the folded trampoline 101. Since the trampoline 101 is folded into a generally three-sided shape and since it is desirable to have a unique stable base and a carrying handle, the preferred shape of the carrying case 100 is a five-sided shape. This carrying case 100 has a top 103, on which is fixed, typically by bolts, pins or other like fasteners, a handle 102. Two diagonal sides 104, 105 extend from the top 103 to two vertical sides 106, 107. The use of diagonal sides 104, 105 is beneficial to the system of this invention because of the generally triangular "tri-fold" shape of the folded trampoline device 101. The bottom 108 is attached to the vertical sides 106, 107. The bottom 108 of the present preferred embodiment of this invention is provided with two feet 109*a,b*, as well as wheels, shown in FIG. 2*b*, to provide support for the carrying case 100. In the present embodiment of this invention, the feet 109*a,b* are made of rubber or another slide resistant material. The feet 109*a,b* are fixed to the bottom 108 of the carrying case 100 by bolts, pins or other similar attachment devices. In the present embodiment of the invention the top 103, diagonal sides 104, 105, vertical sides 106, 107 and bottom 108 are made of a molded or folded single piece of fiberglass. Although, in alternative embodiments, alternative materials, including but not necessarily limited to wood, metal, plastic or other synthetic, formed either as a single piece or as a plurality of pieces or sections attached together to form a carrying case frame. Although not necessary, the present embodiment of the invention includes a nylon, vinyl or cloth cover attached about the exterior of the top 103, diagonal sides 104, 105, vertical sides 106, 107 and the bottom 108. This cover is fixed in place using standard mounting hardware, such as bolts, pins, adhesive, straps or the like. Within the carrying case 100 is provided one or more restraining straps 110, the ends of which are attached, preferably to the top 103, diagonal sides 104, 105, vertical sides 106, 107 and the bottom 108. The present restraining strap 110 consists of two segments 111*a*, 111*b*, which can be connected together or disconnected using a standard hook and loop device 112. While this present embodiment shows only a single restraining strap 110, alternative embodiments, may use multiple straps. Also, while the present embodiment of the restraining strap 110 uses a hook and loop closure 112, alternative restraining straps may use a buckle, snaps and/or may be a single elastic device.

Figure 2A:
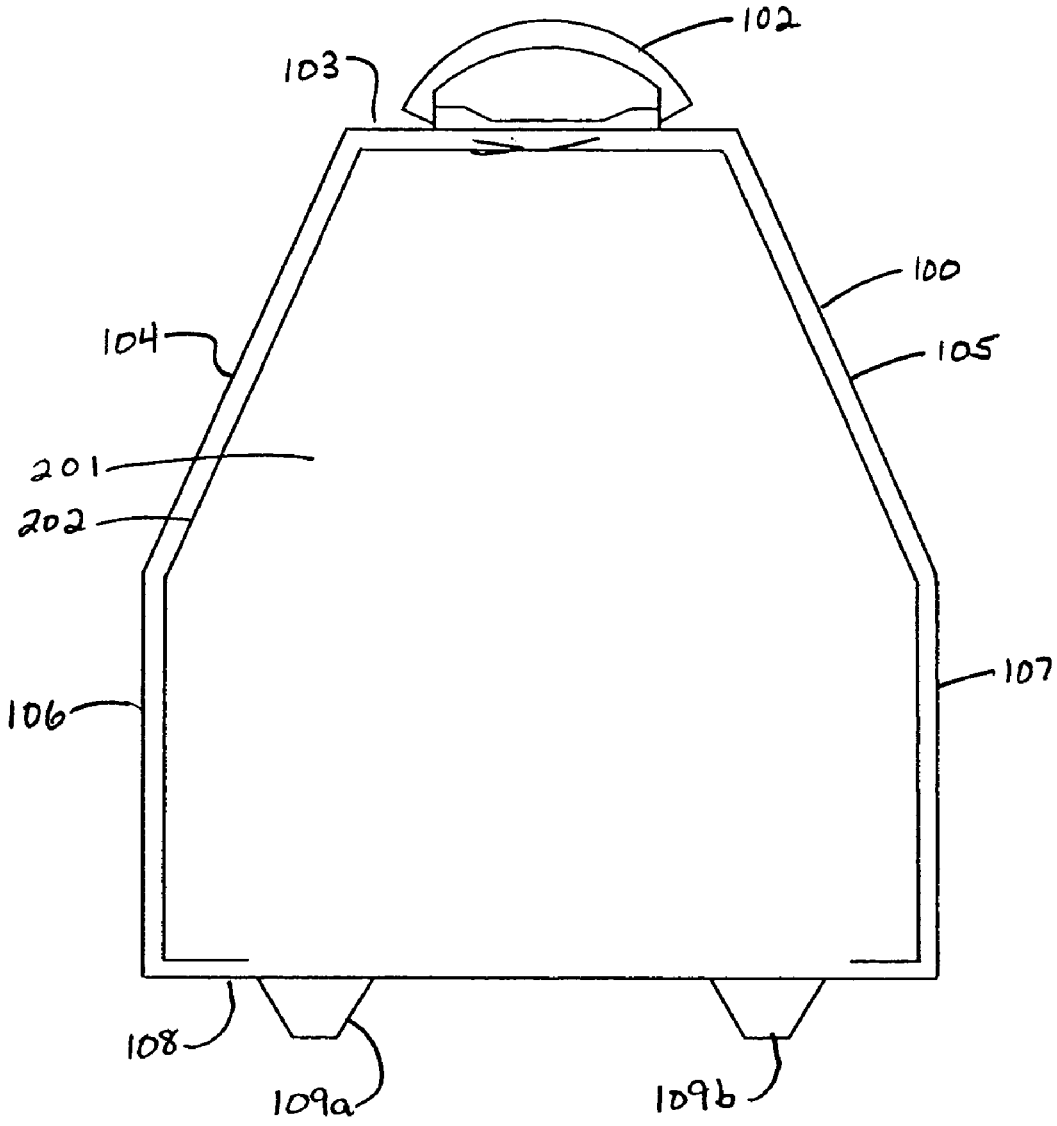
FIGS. 2*a*, 2*b*, 2*c*, 2*d* and 2*e* are front, back, top, bottom and side views of the carrying case of this invention.

FIG. 2*a* shows a front view of the carrying case 101 of the present embodiment of the invention. A front panel 201 is provided attachable to the top 103, diagonal sides 104, 105, vertical sides 106, 107 and the bottom 108, collectively or individually the carrying case frame. In the present embodiment the front panel 201 is attachable and openable through use of a zipper closure device 202, although in alternative embodiments, hook and loop, slide, hinged or snap closure device can be substituted without departing from the concept of the invention. Typically, in the present embodiment, the front panel 201 is composed of nylon, vinyl, cloth or canvas, in some embodiments, with a waterproof or resistant coating. In alternative embodiments, the front panel 201 may be a hard plastic, fiber glass, composite, metal or wood or the like material, fixed by hinges and latches, snaps, pins, screws or the like to the carrying case frame.

Figure 2B:
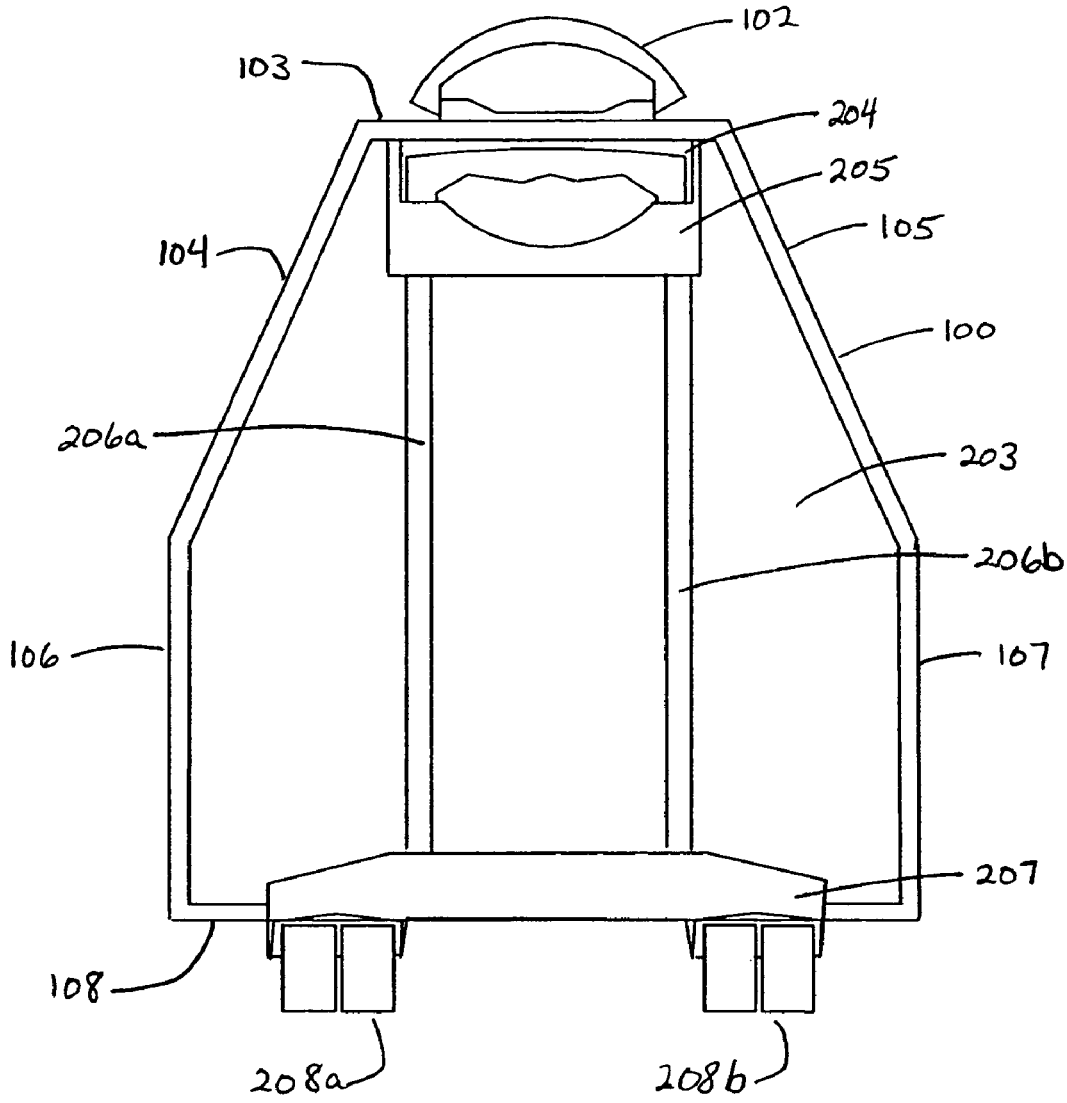

FIG. 2*b* shows the rear view of the present preferred carrying case 100. This view shows a bottom support 207 mounted to the bottom 108 of the carrying case 100. The bottom support 207 is presently fixed to the bottom 108 by bolts, although in other alternative embodiments, screws, pins, clips and the like may be substituted without departing from the concept of this invention. The bottom support 207 includes the mounting fixtures for attaching wheels 208*a, b* to the bottom 108 of the carrying case 100. In the present embodiment two wheel assemblies 208*a, b*, each consisting of a pair of wheels are used. In alternative embodiments, the attached wheels may be one or more wheels, so long as they are position to effectuate the transport of the carrying case 100. Also fixed to the bottom 108, in the present embodiment, are a pair of support/extension rails 206*a,b*. In alternative embodiments, the number of rails may be changed without departing from the concept of this invention. The support/extension rails 206*a,b* serve to provide mechanical support to the rear 203 of the carrying case 100 and in the present embodiment, include extension members which can be extended to extend a second handle 204 to more easily pull the carrying case 100, while maintaining contact between the wheel assemblies 208*a,b* and the ground, without requiring the user to unduly bend over. The second handle 204 and the extension members are accessible from the second handle fixture 205, which is fixed to the top 103 of the carrying case 100, typically by bolts, although alternatively screws, pins, clips and the like can be used to fix the second handle fixture 205 to the top 103. In alternative embodiments, this second handle fixture 205, may be detached from the rear 203 of the carrying case 100 and attached to the trampoline 101 for use as a balance bar, as further shown in FIGS. 2*f* and 2*g*. The rear 203 of the carrying case, in the present embodiment is composed of vinyl, cloth or canvas, in some embodiments, with a waterproof or resistant coating. In alternative embodiments, the rear panel 203 may be a hard plastic, fiber glass, composite, metal or wood or the like material, fixed by bolts, pins, screws or the like to the carrying case frame.

Figure 2C:
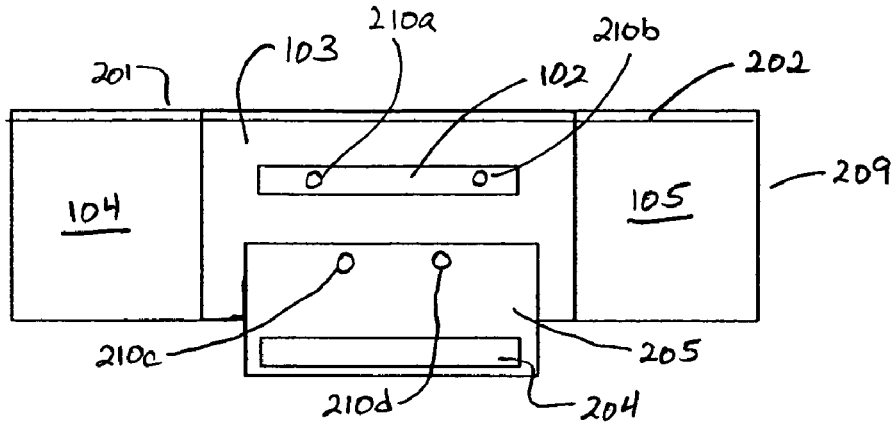

FIG. 2*c* shows the top view 209 of the present carrying case 100 of this invention, in particular this view shows the present relationship between the top 103, the diagonal sides 104, 105 and the handle 102 and second handle 204. The top 103 is shown with the handle 102 fixed by bolts 210*a,b* to the top 103. The second handle fixture 205 is also shown fixed by bolts 210*c,d* to the top 103. The second handle 204 is fit to the second handle fixture 205.

Figure 2D:
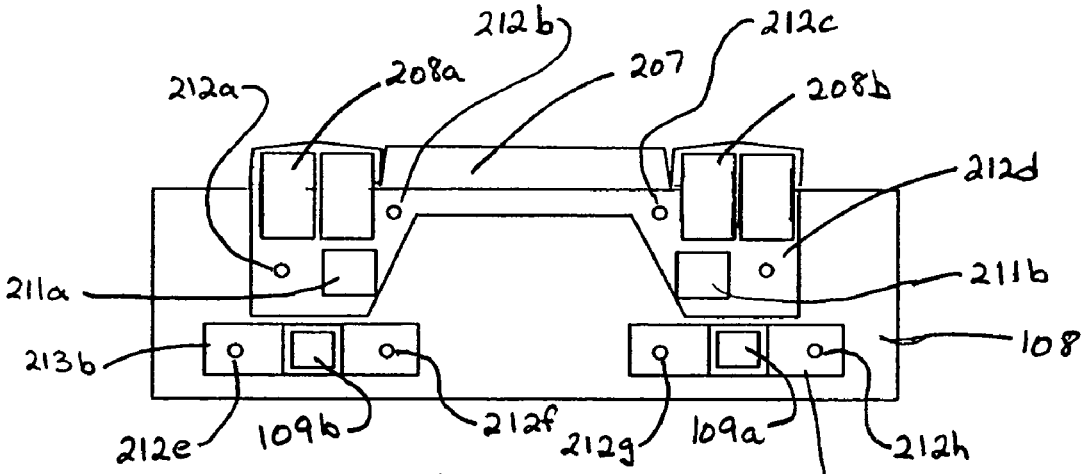

FIG. 2*d* shows the bottom 108 of the present embodiment of the carrying case 100 of this invention. The wheel assemblies 208*a,b* are shown attached to the bottom support 207, which in turn is fixed, by bolts 212*a,b,c,d*, to the bottom 108. Support blocks 211*a,b* are provided on the present embodiment of the bottom support 207 to provide additional support strength. The feet 109*a,b* are shown with a base 213*a,b*, which is fixed, by bolts 212*e,f,g,h*, to the bottom 108 of the carrying case 100.

Figure 2E:
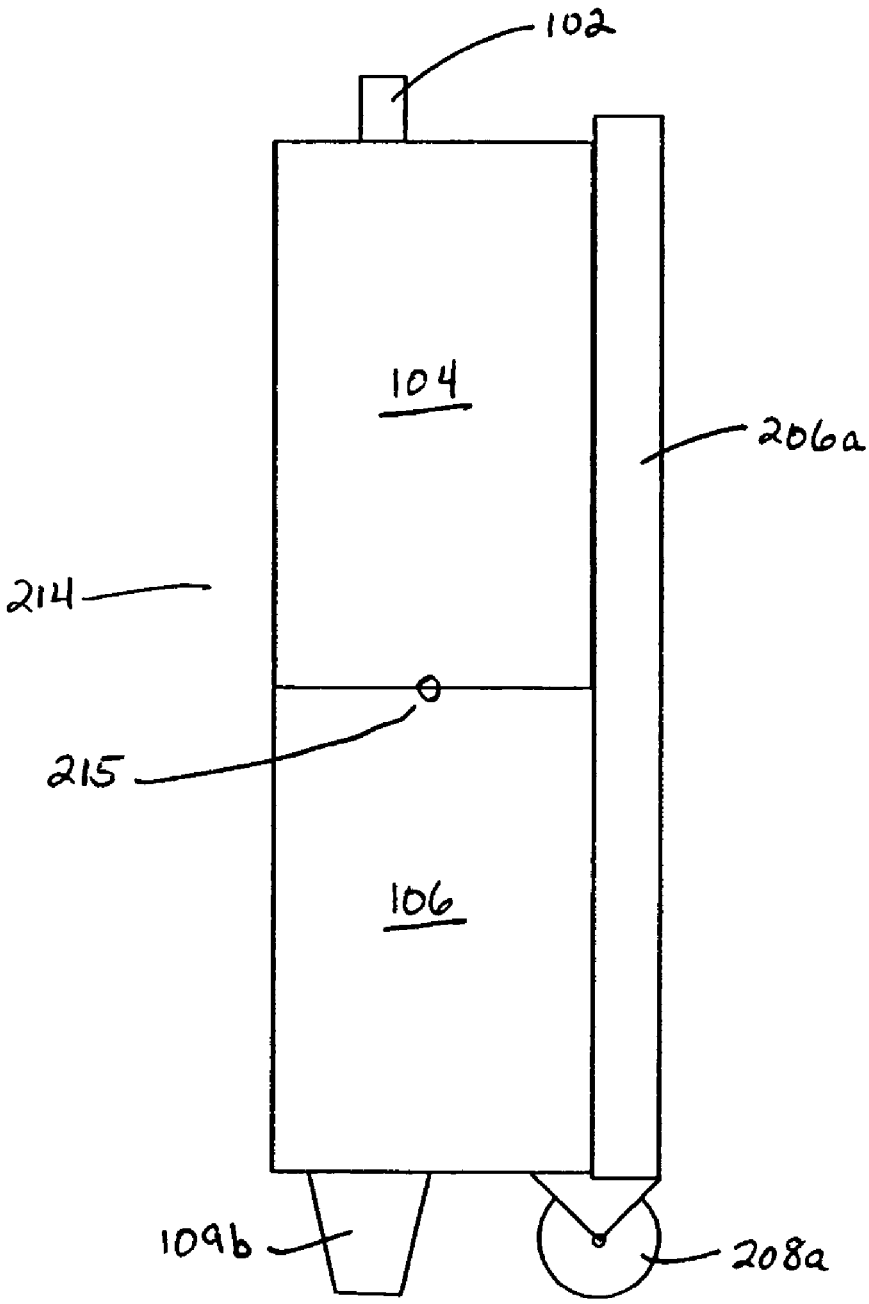

FIG. 2*e* shows the right side view 214 of the present embodiment of the carrying case 100 of this invention. This view 214 shows the mounting bolt 215 fixing the vinyl, cloth or canvas cover to the diagonal side 104 and vertical side 106. The left side view (not shown) is a mirror image of this right side view 214.

Figure 2F:
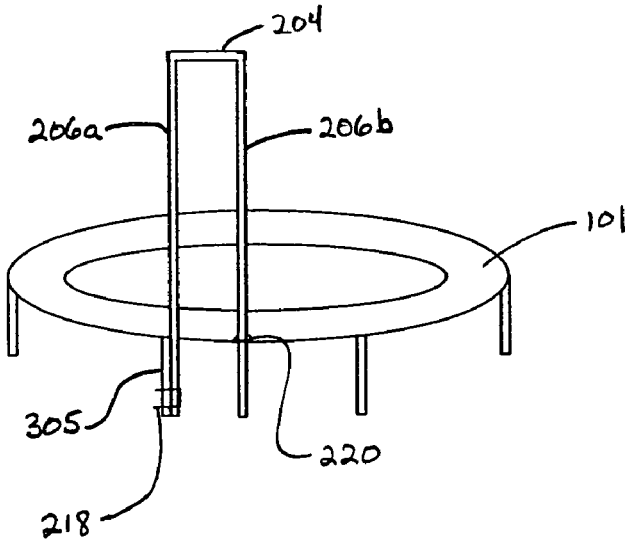
FIGS. 2*f* and 2*g* are views of alternative embodiments of the carrying case, with a detachable height adjustable second handle for use as a balance bar.
Figure 2F:
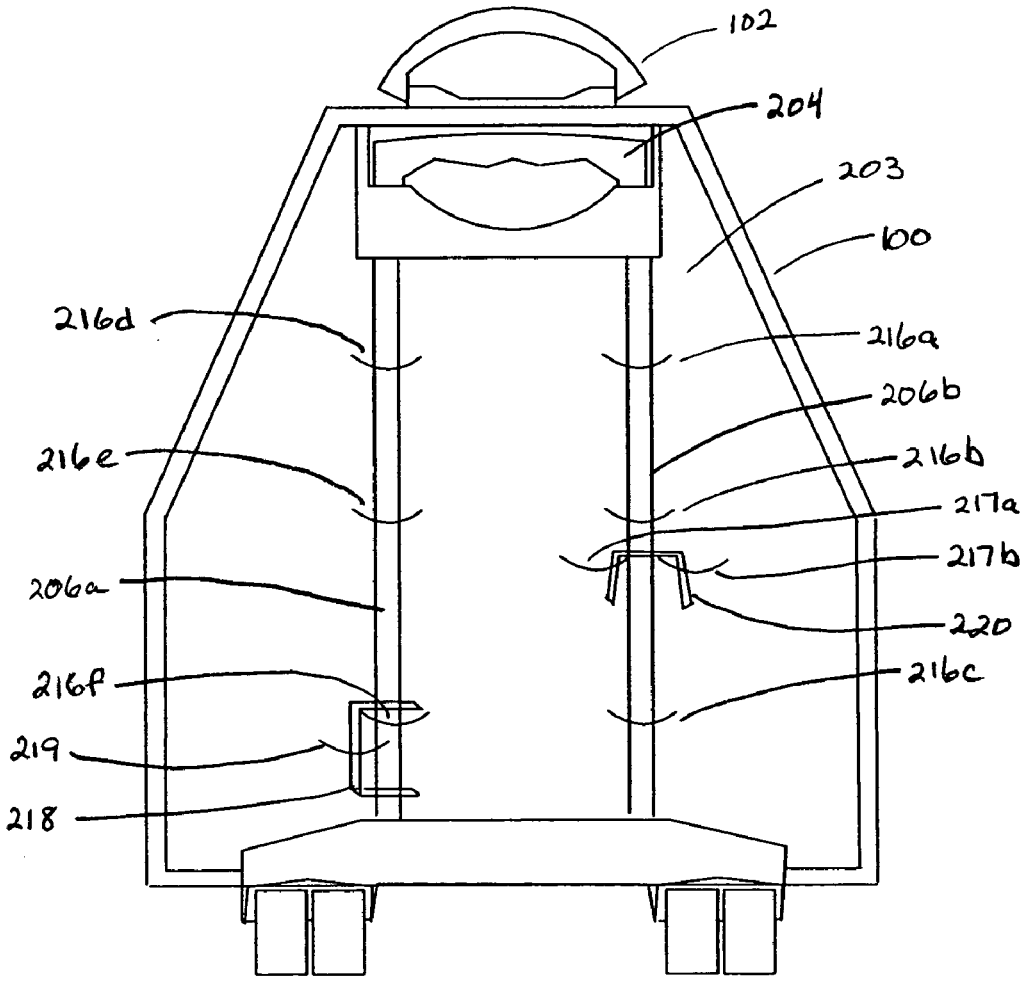

FIG. 2*f* shows a view of an alternative embodiment of the carrying case 100 having a detachable height adjustable second handle 204 for use as a balance bar. The balance bar of this embodiment consists essentially of the handle 204, a first vertical portion 206*a* and a second vertical portion 206*b*. The first and second vertical portions 206*a,b* are removably held in place on the rear 203 of the carrying case 100 by a number of clips or straps or the like 216*a,b,c,d,e,f*. When removed from the carrying case 100, the balance bar is removably fixed to a leg 305 of the trampoline device 101. Presently, the first vertical portion 206*a* is fixed to the leg 305 by a cylindrical sleeve 218, which fits about, and can be held in place by a pin, screw, bolt or the like, the leg 305. The second vertical portion 206*b* is likewise removably fixed to the frame of the trampoline device 101 by a hook 220, typically by locating the hook 220 about the second vertical portion 206*b* and into an opening, or hole, in the frame of the trampoline 101. Typically, when the second handle assembly is attached to the rear 203 of the carrying case 100, the cylindrical sleeve 218 and the hook 220 are removably fixed to the rear via clips, straps or the like 217*a,b*, 219.

Figure 2G:
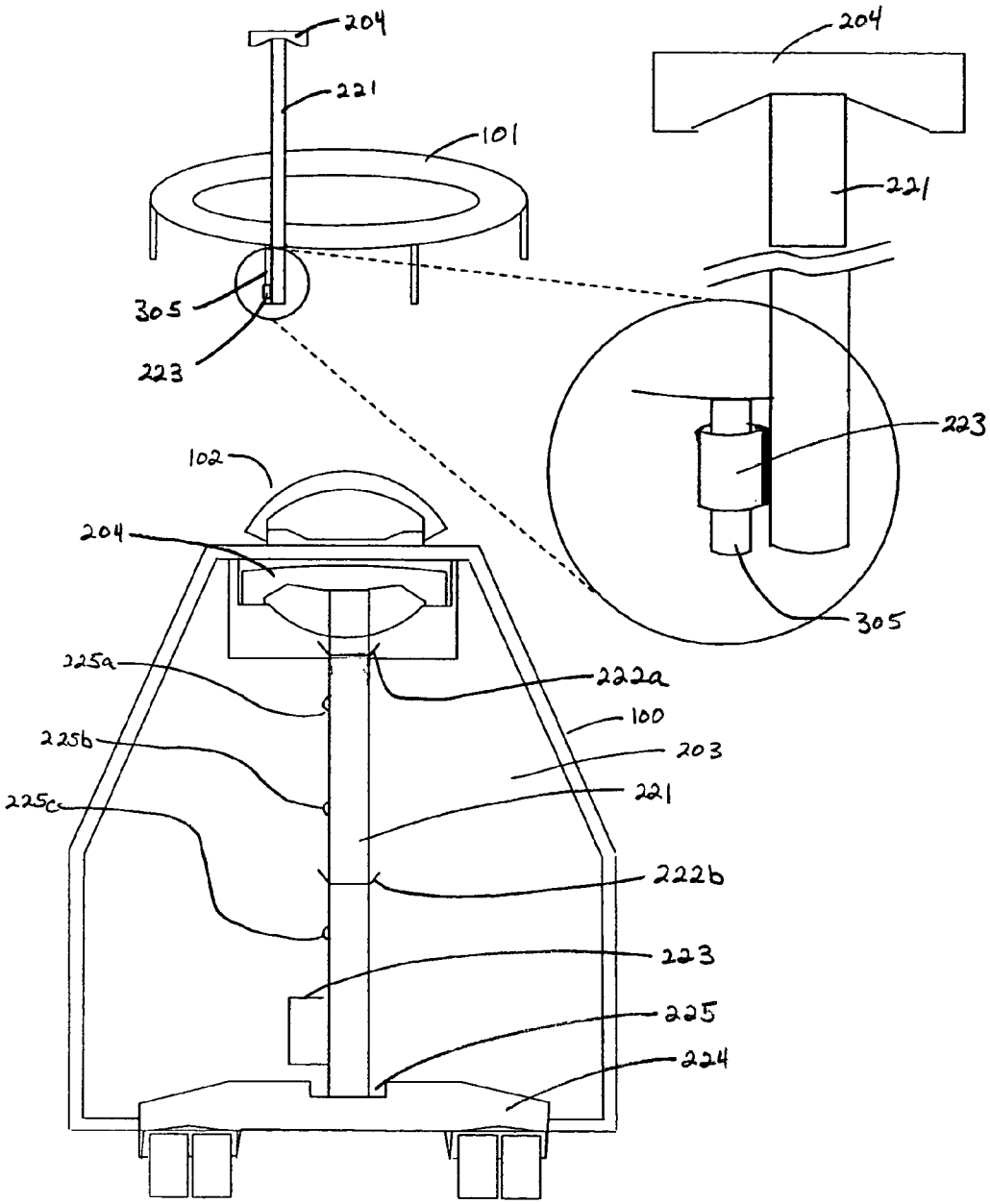

FIG. 2*g* shows a view of another alternative embodiments of the carrying case, with a detachable height adjustable second handle for use as a balance bar. The balance bar of this embodiment consists essentially of the handle 204 attached to the top of a vertical portion 221. The vertical portion 221 is removably held in place on the rear 203 of the carrying case 100 by a number of clips or straps or the like 222*a,b*, with the bottom of the vertical portion 221 fitting within a recess 225 in the bottom support 224. When removed from the carrying case 100, the balance bar is removably fixed to a leg 305 of the trampoline device 101. Presently, the vertical portion 221 is fixed to the leg 305 by a cylindrical sleeve 223, which fits about, and can be held in place by a pin, screw, bolt or the like, the leg 305. In this embodiment, the cylindrical sleeve 223 is typically welded or other wise permanently attached to the vertical portion 221, as shown in the inset of this FIG. 2*g*. The balance bar of this embodiment is provided with telescoping sections released by pressing on one or more push pins 225*a,b,c* and maintained in position by releasing the one or more push pins 225*a,b,c* at the appropriate locations on the vertical portion 221.

Figure 3:
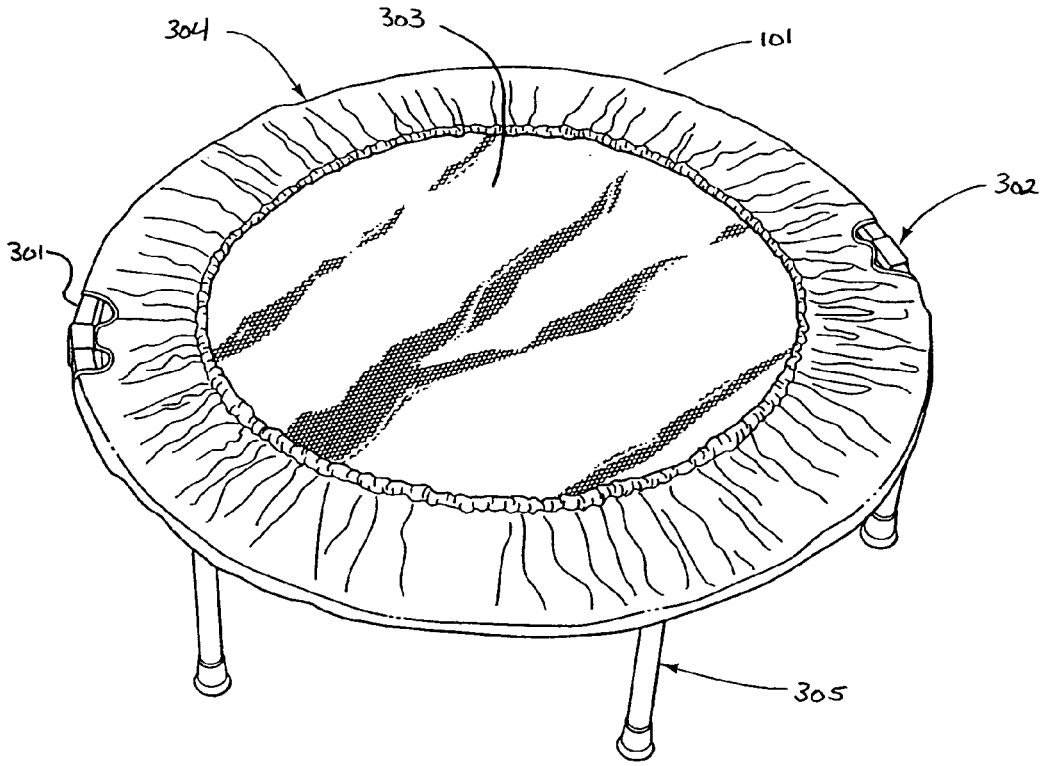
FIG. 3 is an illustration of the unfolded trampoline apparatus of this system.

FIG. 3 is an illustration of the trampoline apparatus 101 of this system unfolded for use as an exercise device. In the present embodiment of this invention, the trampoline 101 includes a frame 301, with a plurality of hinges 302 for folding the frame 301, a mat 303 and pad 304. The pad 304 (also referred to as a cover) is arranged about the frame 301 in a conventional manner so as to cover the springs 502 (see FIGS. 5 and 6) adjacent the upper surface of the mat 303 to enhance the safety and aesthetics of the trampoline 101. The frame 301 is held by a plurality of legs 305. The portability of the trampoline system of this invention is facilitated by the foldability of the frame 301 and the legs 305, which are adapted to be folded. In the present embodiment of the invention, the diameter of the frame 301 is about forty inches and the height of the legs 305 is about 10 inches. In alternative embodiments, the sizes of the components can be changed. Also, although the present preferred embodiment of the invention has a trampoline 101 having a circular configuration when in use, alternative trampoline shapes, including but not limited to hexagonal, octagonal, square, rectangular, oval and the like, can be substituted without departing from the concept of this invention. The frame 301 and legs 305 are presently made of metal, although in alternative embodiments other materials, such as wood, plastic, reinforced plastic, composites and the like can be used. The embodiment illustrated in this FIG. 3 implies six legs 305. In alternative embodiments, the number of legs 305 can be varied, so long as sufficient stability is provided. As noted above, the legs 305 are configured so as to be foldable. This folding of the legs 305 is shown in further detail in FIG. 6 and described below.

Figure 4:
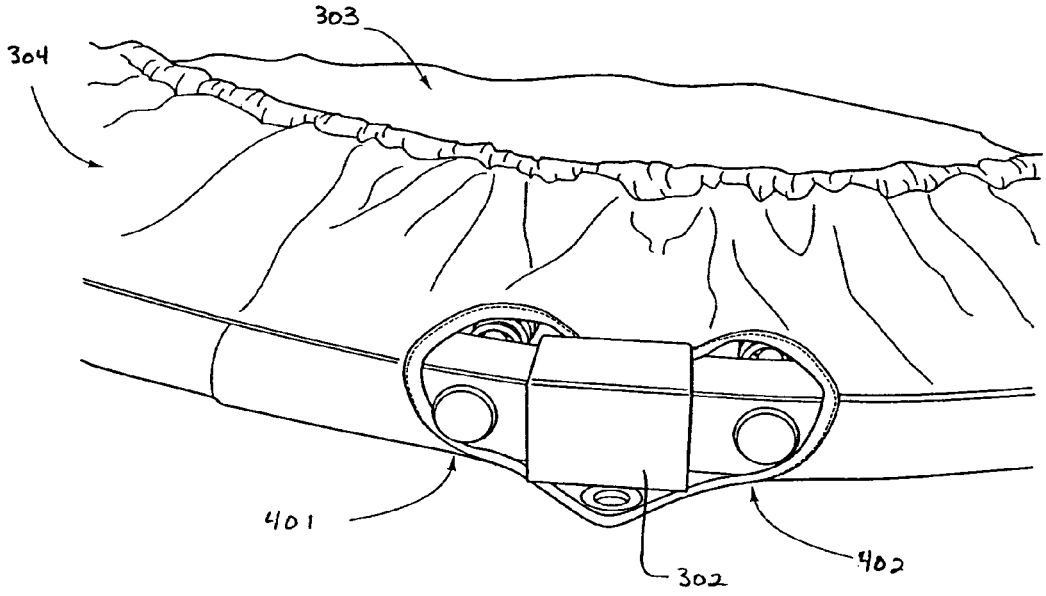
FIG. 4 is a close-up view of a hinge in the trampoline apparatus of the present invention.

FIG. 4 is a close-up view of a hinge 302 in the trampoline apparatus 101 of the present invention. The hinge 302 is shown holding two frame sections 401, 402 together. In the present embodiment, six frame sections are used to make the frame 301. The number of frame sections depends on the geometry of the trampoline, the length of the frame sections and the size of the trampoline.

Figure 5:
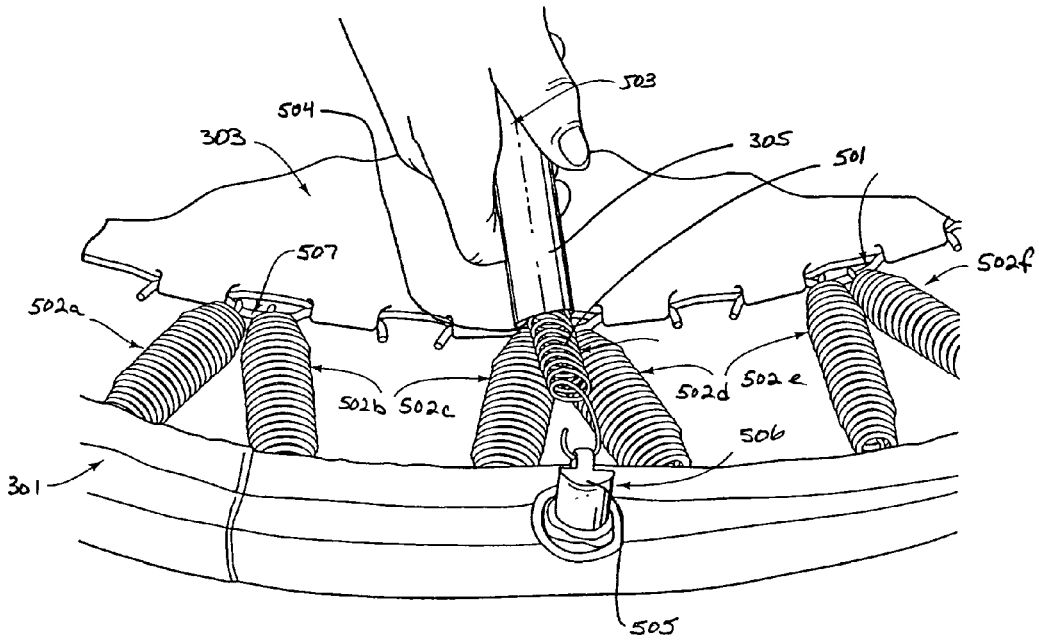
FIG. 5 is a close-up view of the attachment of a leg in the trampoline apparatus of the present invention.
Figure 6:
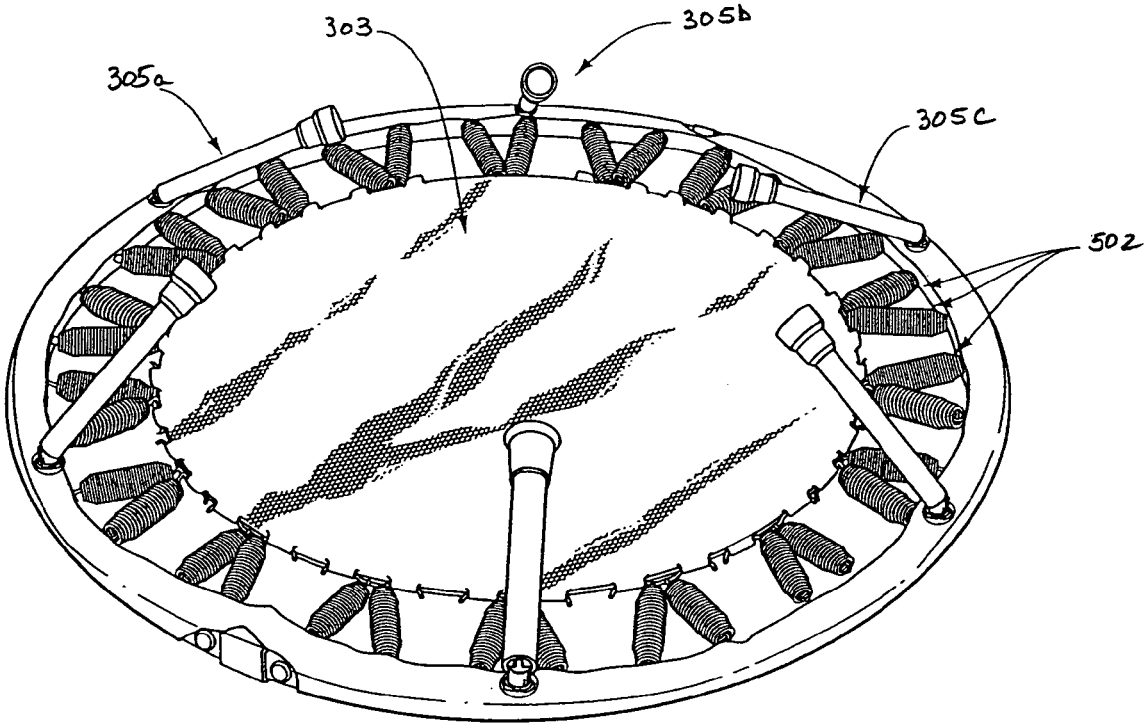
FIG. 6 is a view of the trampoline apparatus with the legs partially folded.

FIG. 5 is a close-up view of the attachment of a leg 305 in the trampoline apparatus 301 of the present invention. In this embodiment of the legs 305, each has a spring 501 connecting the base 506 to the extension member 503. The spring 501 is removably connected to the base 506. When in a non-folded position, the female end 504 of the extension member 503 fits over and encompasses the mail end 505 of the base 506 to provide a rigid structure for supporting the loads to which the trampoline 101 will be subjected in use. The extension member 503 is held in this non-folded position by the action of the spring 501 (or similar mechanical device). In the folded position, as illustrated in FIG. 6, the female end 504 of the extension member 503 is removed (using force to overcome the spring 510 tension) from the base 506 and the extension member 503 is folded relative to the base 506. The mat 303 is shown connected to the frame 301 by a plurality of springs 502*a,b,c,d,e,f*, which are connected to the mat 303 via hooks 507, positioned on the edge of the mat 303 at approximately equal distances. These hooks 507 are typically made of steel, although the steel material can be substituted with other relatively hard metals, rubber, plastic and/or composite material. The hooks 507 are used to equally apportion the force applied via the springs 502*a,b,c,d,e,f* along the edge of the mat 303. The number of hooks 507 can be selected depending on the structural characteristics (i.e., flexibility and bounce) of the mat 303.

Optionally, the trampoline of the present invention can include braces as is known in the art. With such braces, the mat 303 can be maintained in a substantially vertical or inclined plane (not shown), permitting the trampoline to be used as a rebound device for various projectiles. See, for example, U.S. Pat. No. 4,415,151, the disclosure of which is hereby incorporated by reference in its entirety.

The mat 303 presently is a "standard" Permatron trampoline mat, see for example U.S. Pat. No. 4,386,772, the disclosure of which is hereby incorporated by reference in its entirety.

FIG. 6 is a view of the trampoline apparatus 101 with the legs 305*a,b,c* partially folded towards the mat 302.

Figure 7:
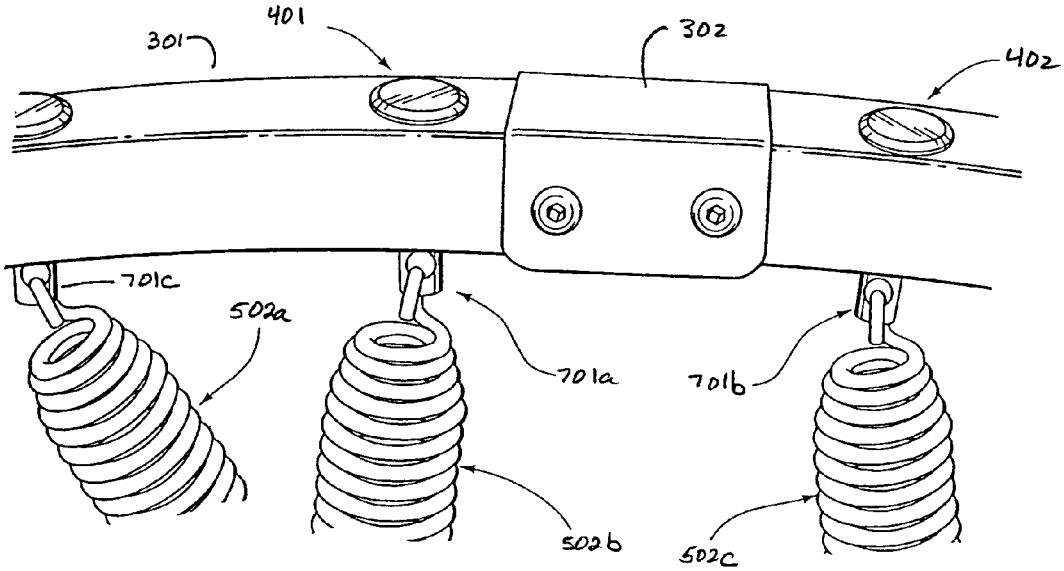
FIG. 7 is an alternate close-up view of a hinge in the trampoline apparatus of the present invention.

FIG. 7 is an alternate close-up view of a hinge 302 and spring assembly in the trampoline apparatus 101 of the present invention. The springs 502*a,b,c* are connected to the frame 301 sections 401, 402 via pins 701*a,b,c*. The pins 701*a,b,c* are typically made of steel, although other hard metals, plastic and/or composites can be substituted for the steel material. The number of springs 502 and pins 701 are selected to correspond with the number of hooks 507 as required by the structural characteristics of the mat 303. The hinge 302 provides the present means for pivoting the frame sections 401, 402 relative to each other. Alternative suitable pivoting means can be substituted for the hinge 302, see, for example, U.S. Pat. Nos. 4,386,772, 4,415,151 and 6,110,074, the disclosures of which are hereby incorporated herein by reference in their entirety.

Figure 8:
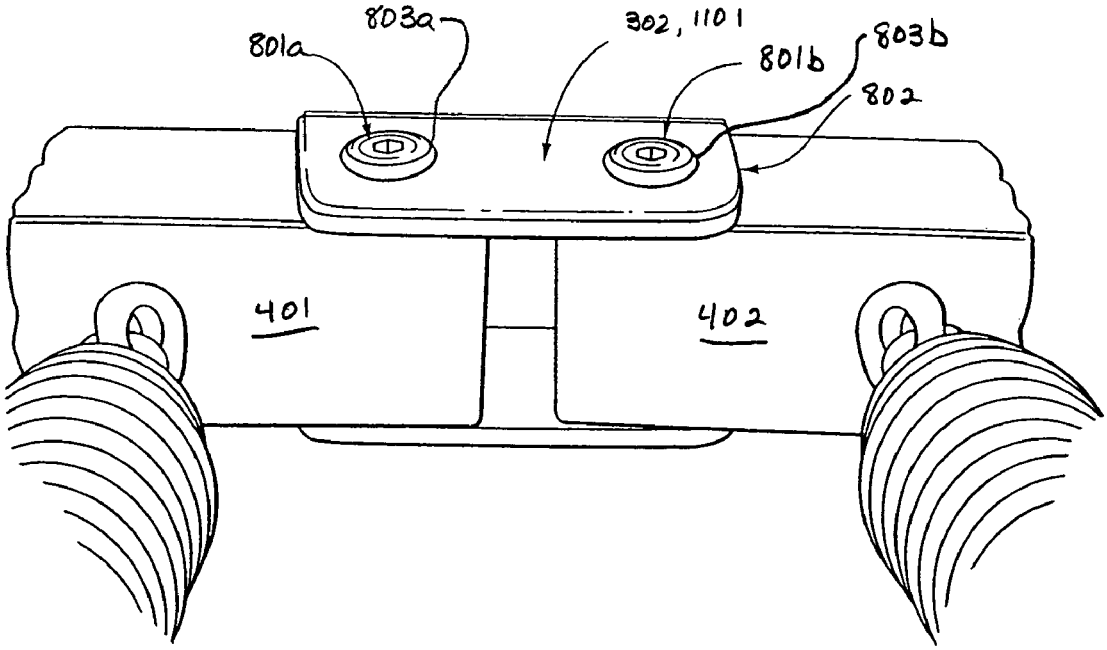
FIG. 8 is an alternative close-up view of a hinge in the trampoline apparatus of the present invention.
Figure 9:
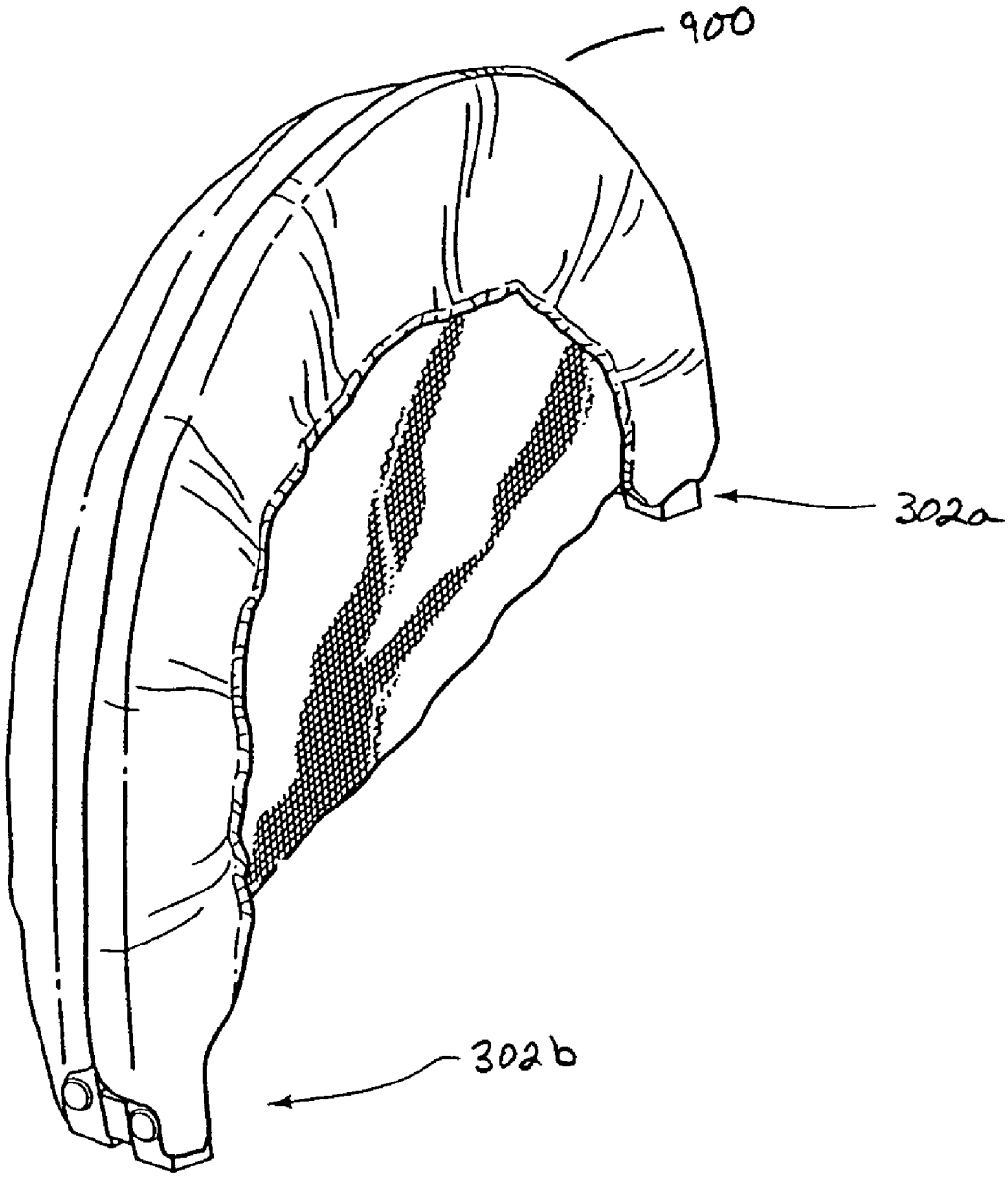
FIG. 9 is a view of the trampoline apparatus of the present invention in a partially folded configuration.
Figure 10:
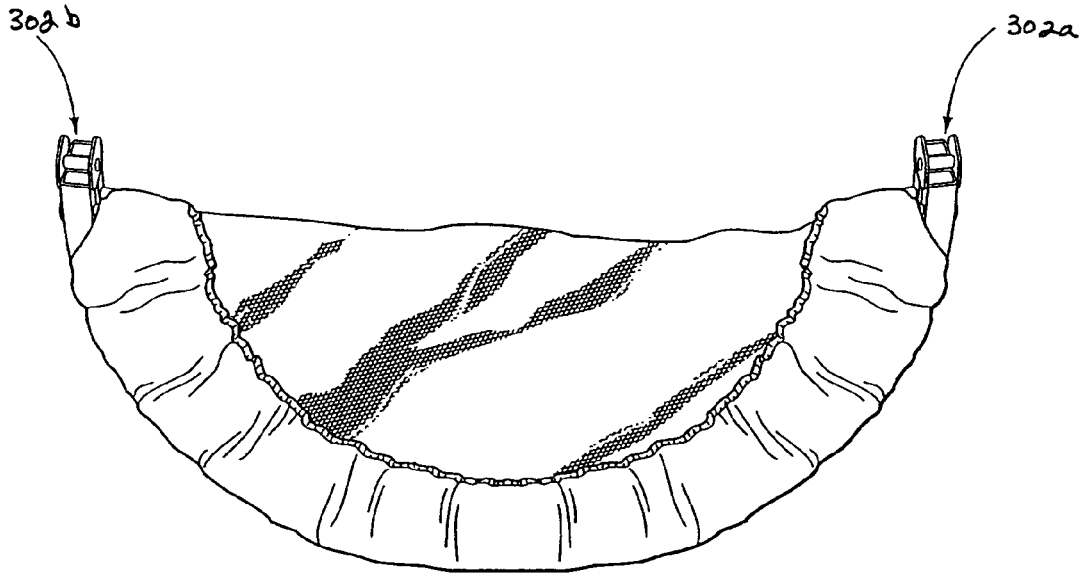
FIG. 10 is an alternative view of the trampoline apparatus of the present invention is partially folded configuration.
Figure 11:
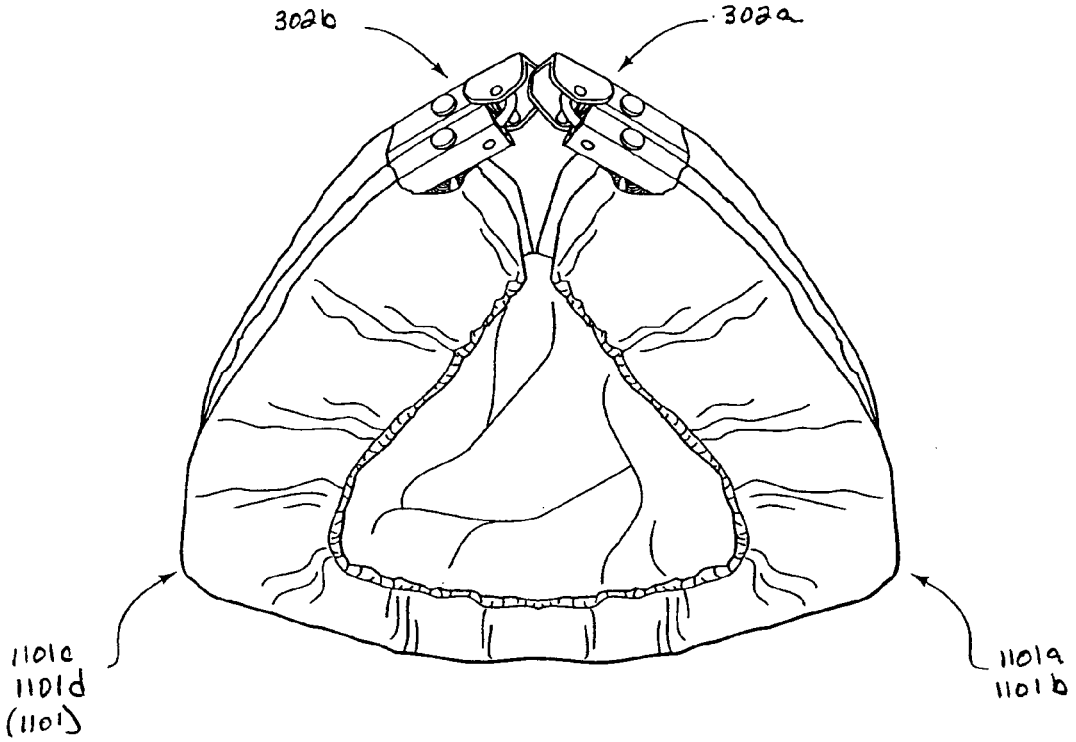
FIG. 11 is a view of the trampoline apparatus of the present invention in a fully folded configuration, suitable for insertion within the carrying case of this system.

Again, the present preferred pivoting means, as illustrated in FIGS. 7-11 are a pair of hinges 302 and a set of hinges 1101. As shown, the hinges 302 connect and encompass the ends of the respective frame sections 401, 402. Thus, the hinges 302 are able to yield as the various loads are applied to the trampoline when it is in use. These hinges 302 are also disposed so as provide a pivoting means permitting the trampoline to be further collapsed or folded. In the present embodiment of the invention, the four hinges 1101 are positioned at 60 degree angles along the periphery from the hinges 302, that is, respective to a single hinge 302, four hinges 1101 are located at 60, 120, 240, and 300 degrees. (The second hinge 302 is located at 180 degrees.) In this configuration, the hinges 1101 permit the frame 301 to be moved between a first folded position, as seen in FIGS. 9 and 10, to a second (and more compact) folded position, shown in FIG. 11. This second folded position is substantially triangular in shape, and is referred to as a "tri-fold," and is the folded position appropriate for placement within the carrying case 100, as shown in FIG. 1. If desired, in alternative embodiments, additional hinges 1101 can be used to provide even more collapsed configurations. Any suitable hinges 1101 known in the art, permit such a folding configuration can be employed in the present invention. In the present embodiment of the invention, the hinges depicted in FIGS. 4, 7 and 8 as 302 can also be used as the hinges 1101. Accordingly, the hinges 1101 connect and encompass the ends of the respective frame sections. And, the hinges 1101 are also able to yield as the various loads are applied to the trampoline 101 in use. In sum, in the present embodiment of this invention, the hinges uses as hinges 302 and the hinges used as hinges 1101 are substantially similar, if not identical, and are interchangeable. Using such a configuration, the trampoline 101 can be folded into a semi-circular shape, as shown in FIGS. 9 and 10 along any diametrical line using any two diametrically opposed hinges. The trampoline 101 can then be collapsed into the tri-fold position, using the remaining four hinges, as shown in FIG. 11. Hinges 302 and 1101 are configured to provide lateral flexibility in the framework, thereby decreasing the stresses applied to the hinges (and increasing the operating life of the hinges) when the trampoline is folded. Any suitable hinge accomplishing this function can be employed in this present invention. In one embodiment of the present invention, the hinges 302, 1101 are configured as shown in FIG. 8.

Figure 12:
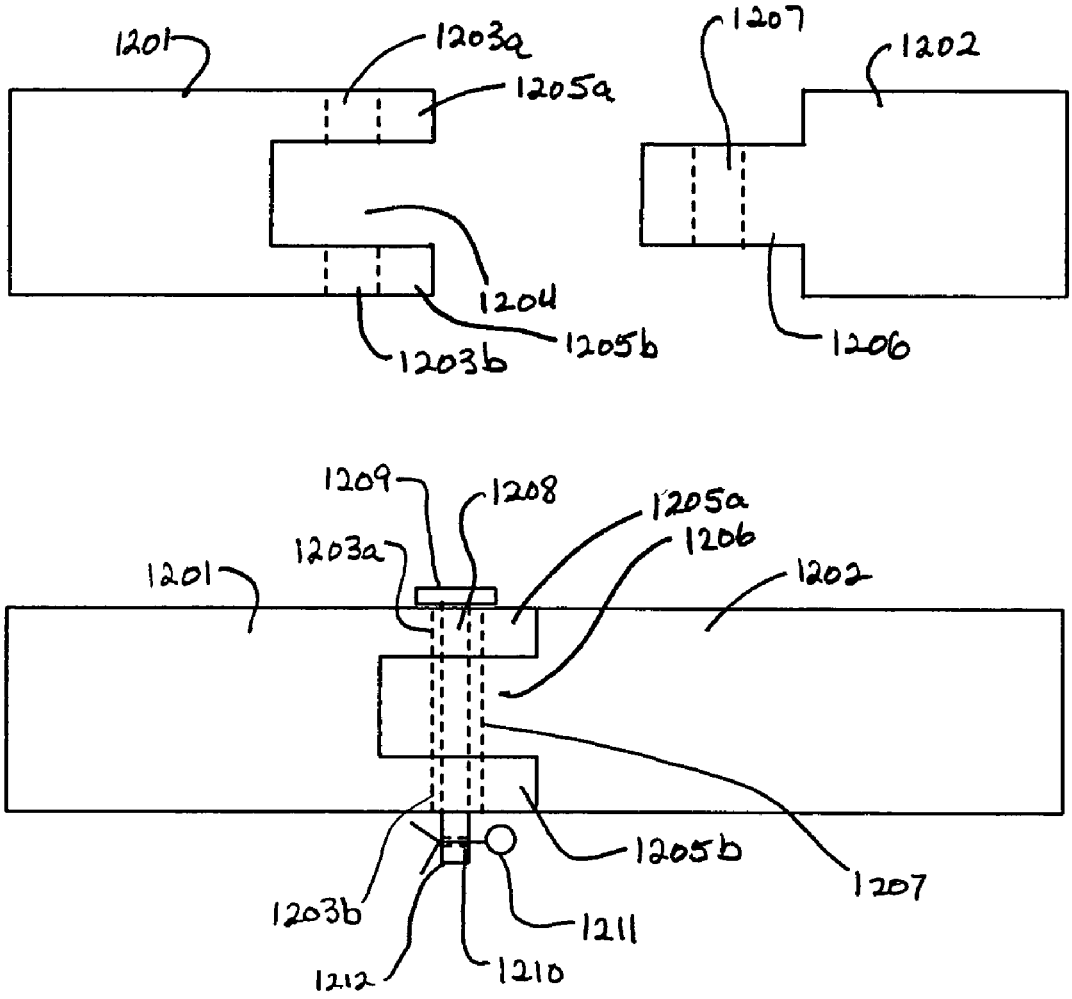
FIG. 12 provides views of an alternative hinge device, suitable for use in the frame of this invention.

FIG. 8 is an alternative close-up view of a hinge 302, 1101 in the trampoline apparatus 101 of the present invention. This hinge 302, 1101 is presently configured as a "C" shaped plate 802 partially enclosing the ends of the frame sections 401, 402 on the outer periphery and sides of the frame sections 401, 402. In alternative embodiments, the hinge may be part of the molded or cast frame, for example, as shown in FIG. 12. The inner periphery of the frame sections 401, 402 are not enclosed by the plate 802. The ends of the "C" shaped plate 802 are removably connected to the frame sections 401, 402 via connectors 801*a,b*. The connectors 801*a,b* in the present embodiment are pins running through holes 803*a,b* in the plate 802 and the sections 401, 402, with retaining rings or clips. Alternative connectors 801*a,b* include but are not limited to bolts and nuts, screws, clips and the like.

With the hinges 302, 1101 configured in this manner, the frame 301 is provided with a high degree of lateral movement. Conventional prior foldable trampolines have hinges that are permanently connected to the frame via welding or molding. When a user bounces on the trampoline, the lateral forces imparted to the hinges from the bouncing motion causes structural damage and helps keep the user more centered when the trampoline is in use. With the hinges of the present invention, however, the hinges 302, 1101 are configured to yield to these lateral forces. Therefore, the hinges 302, 1101 accommodate more flexibility and exhibit less structural damage. With less damage, the operating life of the hinges 302, 1101 (and the exercise apparatus itself) are extended beyond that which is found in the hinges and trampolines previously known in the art.

FIG. 9 is a view of the trampoline apparatus 101 of the present invention in a partially folded configuration. The folding of the trampoline apparatus is accomplished as follows. To begin the folding operation, the extension members 503 of the legs 305 are removed from their bases 506, as shown in FIG. 5. The legs 305 are all folded in an inward position as shown in FIG. 6. Then the exercise apparatus 101, including the frame 301, are folded in half into a semi-circular arrangement 900 by using hinges 302*a,b*. After the first folding operation, the trampoline exercise apparatus 101 can be further collapsed or folded by applying pressure to the outside of hinges 302*a,b* and pivoting about the hinges 1101*a,b,c,d* as shown in FIG. 11, until the hinges 302*a,b* are proximate to each other, see FIG. 11.

In this manner, a compact trampoline is provided, which can be stored and/or transported, in particular within the carrying case 100, in a convenient manner.

FIG. 10 is an alternative view of the trampoline apparatus 101 of the present invention is partially folded configuration. This view provides additional detail of the folded hinges 302*a,b*.

FIG. 11 is a view of the trampoline apparatus 101 of the present invention in a fully folded configuration, suitable for insertion within the carrying case 100 of this system.

FIG. 12 shows an alternative hinge design which permits the folding of the frame 301 of the trampoline device 101. This hinge is formed by connecting the ends 1201, 1202 of two sections of the frame 301. Each end 1201, 1202 is typically molded or cast as part of the frame 301. One end 1201 of the hinge is provided with a cavity 1204, bounded by two arms 1205*a,b*. Holes 1203*a,b* are provided through the arms 1205*a,b* for receiving a locking pin 1208. The second end 1202 has a protrusion 1206, adapted fit within the cavity 1204. The protrusion 1206 is provided with a hole 1207 for receiving the locking pin 1208. The pin 1208 is shown inserted through the holes 1203*a,b*, 1207. The present pin 1208 has a head 1209 on one end and a extended portion 1212, which has a hole 1210 for receiving a locking wire 1211. In the preferred embodiment the fit of the two ends 1201, 1202 is sufficiently loose to permit the desired flex of the frame 301.

The described embodiment of the invention is provided to give the reader a complete understanding of the preferred embodiment of the invention and is to be considered in all respects as illustrative and not as restrictive. Although this embodiment, described in the drawings and the detailed description, includes specific components, quantities of components, dimensions, motors, and materials, the invention is not limited thereto. The scope of this invention, therefore, indicated by the appended claims rather than by the foregoing description. All changes which come within the meaning and range of equivalency of these claims are to be embraced within their scope.

The invention claimed is:

1. A portable exercise system, comprising:

a carrying case including a first handle;

a foldable trampoline adapted to fit within the carrying case;

a second handle assembly attached to the carrying case, wherein said second handle assembly farther comprises a handle portion connected to a vertical portion, wherein said vertical portion is connectable to a leg of said foldable trampoline by a coupling member and wherein said second handle assembly when said vertical portion is connected to said log of said foldable trampoline, provides a balance bar for a user of said foldable trampoline.

2. The portable exercise system of claim 1, wherein the coupling member is a sleeve coupled to the foldable trampoline.

3. The portable exercise system of claim 2, wherein the sleeve is coupled to a leg of the foldable trampoline.

4. The portable exercise system of claim 1, wherein the vertical portion of the second handle assembly comprises being length adjustable.

5. The portable exercise system of claim 1, wherein the vertical portion comprises a first vertical portion and a second vertical portion each coupled to the handle portion.

6. The portable exercise system of claim 5, wherein the foldable trampoline further comprises a frame including a hole through which the second vertical portion may be removably coupled to the foldable trampoline.

7. The portable exercise system of claim 1, wherein the foldable trampoline further comprises six hinges located equidistant along a periphery.

8. The portable exercise system of claim 1, wherein the foldable trampoline further comprises a leg configured to fold inward.

9. A portable exercise device, comprising:

a carrying case including a first handle;

a foldable trampoline disposable within the carrying case; and a second handle assembly attached to the rear of the carrying case, wherein said second handle assembly further comprises a handle portion connected to a vertical portion, wherein said vertical portion is connectable to a leg of said foldable trampoline through a coupling member and wherein said second handle assembly when said vertical portion is connected to said leg of said foldable trampoline, provides a balance bar for a user of said foldable trampoline.

10. The portable exercise device of claim 9, wherein the second handle assembly includes a vertical portion.

11. The portable exercise device of claim 10, wherein the vertical portion comprises being vertically extendable.

12. The portable exercise device of claim 9, wherein the carrying case is generally triangular.

13. The portable exercise device of claim 9, wherein the carrying case is water-resistant.

14. The portable exercise device of claim 9, wherein the handle portion is T-shaped.

15. The portable exercise device of claim 9, wherein the handle portion is U-shaped.

16. A portable exercise system, comprising:

a carrying case, including:

an interior, defined by a top, a first diagonal side, a second diagonal side, a first vertical side, a second vertical side, and a bottom; and an exterior, including a handle fixed to the top, a foot fixed to the bottom, and a wheel assembly fixed to the bottom;

a foldable trampoline substantially disposable within the carrying case; and a handle assembly removably coupleable to each of the carrying case and the foldable trampoline, wherein the handle assembly comprises a handle portion connected to a vertical portion, wherein said vertical portion is connectable to a leg of said foldable trampoline through a coupling member and wherein said second handle assembly when said vertical portion is connected to said leg of said foldable trampoline, provides a balance bar for a user of said foldable trampoline.

17. The portable exercise system of claim 16, wherein the handle assembly further comprises a first vertical portion coupled to a handle.

18. The portable exercise system of claim 17, wherein the first vertical portion comprises being selectably extendable.

19. The portable exercise system of claim 18, wherein the handle assembly further comprises being removably coupleable to a rear of the carrying case and removably coupleable to the foldable trampoline by a sleeve.

20. The portable exercise system of claim 19, wherein the handle assembly further comprises a second vertical portion.

21. The portable exercise system of claim 20, wherein the foldable trampoline includes a hole through which the second vertical portion may extend when the first vertical portion is coupled to the foldable trampoline by the sleeve.

22. The portable exercise system of claim 21, wherein the handle assembly is U-shaped.

23. The portable exercise system of claim 22, wherein the foldable trampoline comprises being generally triangular when in a folded mode.

24. The portable exercise system of claim the 23, wherein the foldable trampoline further comprises six hinges located equidistant along a periphery.

* * * * *